US005191926A

United States Patent [19]

Tinnes

[11] Patent Number: 5,191,926

[45] Date of Patent: Mar. 9, 1993

[54] DEVICE FOR SLAG-FREE POURING WITH CONTINUOUS CASTING MACHINES

[75] Inventor: Bernhard Tinnes, Zollikerberg, Switzerland

[73] Assignee: Metacon AG, Zürich, Switzerland

[21] Appl. No.: 659,334

[22] PCT Filed: Jun. 27, 1990

[86] PCT No.: PCT/EP90/01025

§ 371 Date: Mar. 6, 1991

§ 102(e) Date: Mar. 6, 1991

[87] PCT Pub. No.: WO91/00788

PCT Pub. Date: Jan. 24, 1991

[30] Foreign Application Priority Data

Jul. 8, 1989 [DE] Fed. Rep. of Germany ..... 3922549

[51] Int. Cl.[5] ..... B22D 11/10

[52] U.S. Cl. ..... 164/437; 222/594

[58] Field of Search ..... 164/488, 483, 437; 222/594, 595

[56] References Cited

U.S. PATENT DOCUMENTS 4,394,006 7/1983 Bedell ..... 164/437
4,526,349 7/1985 Schwer .

FOREIGN PATENT DOCUMENTS 083745 7/1983 European Pat. Off. .
8907044 9/1989 Fed. Rep. of Germany .
2200861 8/1988 United Kingdom .

*Primary Examiner*—Kuang Y. Lin
*Attorney, Agent, or Firm*—Wenderoth, Lind & Ponack

[57] ABSTRACT

A device for slag-free discharge into a continuous casting machine has a conventional starting pipe on an inlet of a discharge orifice of a tundish. A separate starting member blocks discharge through the starting pipe and floats upon a melt reaching a desired level. The device has improved features to ensure automatically the timely outflow of slag-free melt to the starting pipe.

18 Claims, 2 Drawing Sheets

DEVICE FOR SLAG-FREE POURING WITH CONTINUOUS CASTING MACHINES

BACKGROUND OF THE INVENTION

The invention relates to a device for slag-free pouring into a continuous casting machine with a slide gate nozzle at the discharge orifice of a tundish and a starting pipe blocking the inlet of the discharge orifice when filling the tundish.

Such devices have as a goal to allow only clean or pure molten metal at as high as possible a temperature or without significant heat loss through cooling into the discharge opening of the tundish and thus through the slide gate nozzle into a mold of the continuous casting machine.

A refractory starting pipe with an ideal break point having the shape of an annular slot and breaking under the burn-through effect and/or the buoyancy of the molten metal is disclosed in DE-OS 3 701 707. The broken off piece of pipe floats and thus clears the way for the melt to the discharge orifice of the vessel via the remainder of the pipe that remains in position at the bottom of the vessel. Thus, the opening procedure is a function of the functional efficacy of the ideal break point at a desired instant. If the ideal break point does not break in time, the break must be produced by manipulating a rod from the outside, a process that is irksome and, especially in the case of multistrand machines, time-consuming and expensive. On the other hand, the ideal break point can function earlier than intended so that slag floating on the molten metal is carried along into the discharge orifice and deposited into the mold via a dummy bar head thereof. Such non-metallic nests in the mold always mean a risk associated with the breakthrough of the melt when the dummy bar starts to withdraw.

Therefore, in the practice one usually drops the application of covering flux for thermal insulation and air shielding of the melt directly after generation of a melt level in the tundish. This does not occur until after the release of the molten metal flow by means of the starting pipe so that a significant heat loss and reoxidation of the melt must be taken into account, a state that can be the cause of melt deposits or freezings forming by themselves in the slide gate nozzle.

SUMMARY OF THE INVENTION

The object of the present invention is to provide improvements with respect to the action of a starting device of the aforementioned type and to facilitate primarily automatically a timely release of slag-free melt at the starting pipe.

This object is achieved according to the invention in that a separate starting member, floating with the rising melt level starting from a predetermined filling level in order to release the molten metal flow, is loosely positioned relative to the starting pipe. In this manner, the release of the starting member and thus the release of the melt outflow is solely dependent on the buoyancy potential of the starting member, which is determined by the choice of body height and the free length of the starting pipe. This means that the liberating or release phase runs its course unimpeded, in contrast to ta device in which a detachable part is arranged on a stationary part by means of a connection that must be destroyed. When seen as a whole, the pouring of a continuous casting machine becomes more reliable, more accurate and more on time, even for multistrand continuous casting machines. In addition, the melt level forming in the tundish can be coated early with a covering flux, which keeps the melt warm and thus prevents freezings in the slide gate valve, without having to fear that the slat and covering flux will drain together with the molten melt into the mold.

In detail, the procedure according to the invention is that a hollow starting member forms an elongation of the starting pipe by resting loosely on an inlet end thereof. To this end, a hollow cylindrical member is advantageous in that it can be readily manufactured and can be effectively heated prior to use together with the tundish. Thus, it is advantageous to provide the starting member with a guide that forms an annular slot between the member and the pipe, that extends along the interior or exterior of the starting pipe and that places and loosely guides the starting member when the member floats. Furthermore, an expedient embodiment of the invention provides that, instead of a starting member resting on the inlet end of the starting pipe and equipped with or without a guide, an internal or external tubular starting member projecting above the starting pipe is provided with an annular slot, such that the tubular starting member can be braced against the vessel bottom or against the starting pipe. In the case of both the starting member provided with a guide and resting on the starting pipe and a tubular starting member, the starting pipe and starting member can be designed complementarily conically to one another. Thus, the annular slot between the starting pipe and the starting member becomes larger as a function of the rate of rising of the starting member, a feature that provides for an enlarging gentle discharge of melt via the inlet end of the starting pipe.

Leading inlet passages, expanding in cross section in the buoyancy direction of the starting member, can be provided on the inlet end of the starting pipe. This also provides for the enlarging gentle discharge of molten metal via the inlet end of the starting pipe, particularly in the case of a tubular starting member.

In addition, for the gentle discharge of molten melt, radial discharge orifices that are covered by the tubular starting member and whose cross section of flow becomes continuously larger in the buoyancy direction of the starting member can be arranged in the starting pipe near the vessel bottom. Thereby, when the starting member rises, discharge is through the discharge orifices and then discharge also is at the inlet end of the starting pipe. Thus, in connection therewith, the invention also proposes that the area of the starting member opposite the discharge orifices be designed at a flexible ceramic fiber seal, a feature that also contributes to the proper functioning of the device.

BRIEF DESCRIPTION OF THE DRAWINGS

The invention will be explained further with reference to the accompanying drawings, wherein:

FIGS. 2 to 5 are sectional views of various embodiments of the casting device of the invention, wherein FIGS. 4 and 5 are illustrated on a somewhat enlarged scale.

DETAILED DESCRIPTION OF THE INVENTION

Figure 1:
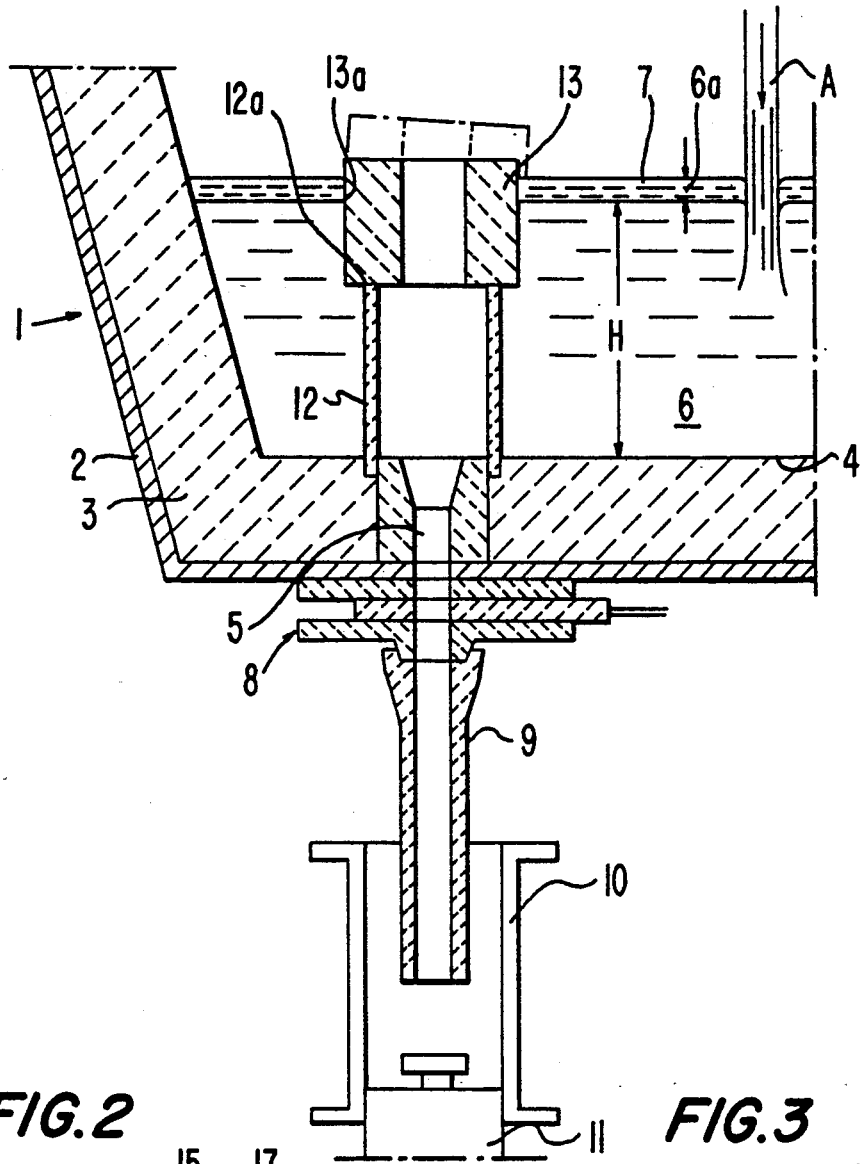
FIG. 1 is a sectional view of the basic arrangement of a continuous casting machine.

According to FIG. 1, a current of molten steel A flows from a controlled nozzle of a casting ladle (not illustrated) into a tundish having a plate shell 2, a refractory lining 3 and a discharge orifice 5 arranged in vessel bottom 4. In vessel 1 is molten melt 6 on which floats a slat cover 7 that can include contaminants, for example, in the form of oxides and a covering flux that is applied in order to prevent reoxidation and heat emission of the melt. In principle, the object is to prevent the non-metallic material resting on the surface or slot 7 from flowing into the discharge orifice 5 and thus via a slide gate nozzle 8 and an immersion pipe 9 into a continuous casting mold 10 when filling the tundish 1 with molten melt 6. Slag 7 arriving in mold 10 would be deposited via dummy bar 11 and lead unquestionably to a melt breakthrough when the strand withdrawing device is switched on.

Therefore, during the phase of filling tundish 1, the discharge orifice 5 is blocked by means of a refractory starting pipe 12 arranged on vessel bottom 4 coaxially above orifice 5. A refractory hollow cylindrical starting member 13 rests loosely on inlet end 12*a* of starting pipe 12 and has a lower mass density than the molten melt 6 to be poured. In particular, starting member 13 represents an elongation of starting pipe 12 in order to ensure that a specific melt level 6*a* having a level height H is reached in the tundish 1 before the discharge of molt 6 begins via the starting pipe inlet end 12*a*, discharge being enabled since the starting member 13 will float upwardly as indicated by the dash-dotted lines. The necessary height 13*a* of the starting member 13 for proper operation of the starting member 13 is determined as a function of its density and the length of starting pipe 12. The effective weight of the starting member 13 decreases steadily with the rise in melt level 6*a*, but member 13 does not lift upwardly until there is no longer any risk of inflow into pipe 12 of the slag 7 together with melt 6. Owing to the gentle lifting off of starting member 13, the discharge of the melt via the inlet end 12*a* of starting pipe 12 begins smoothly and evenly, i.e. without any discharge turbulence, so that at the start of buoyancy or lifting of starting member 13, the slag cover 7 does not need to be spaced far away from inlet end 12*a* of starting pipe 12.

Starting from level height H, the melt level 6*a* continues to rise while melt 6 flows through discharge orifice 5 into the mold 10 until a desired filling level within tundish 1 (not shown) is reached. Thereupon, the desired level that is achieved is maintained by means of control engineering, coordinated with the slide gate nozzle 8 controlling the inflow to mould 10 from orifice 5 of tundish 1.

During the course of the casting process that usually persists for several hours, the starting pipe 12, that is made of a material that can be consumed by the melt, usually dissolves so that at the end of the casting process tundish 1 can be totally emptied.

Figure 2:
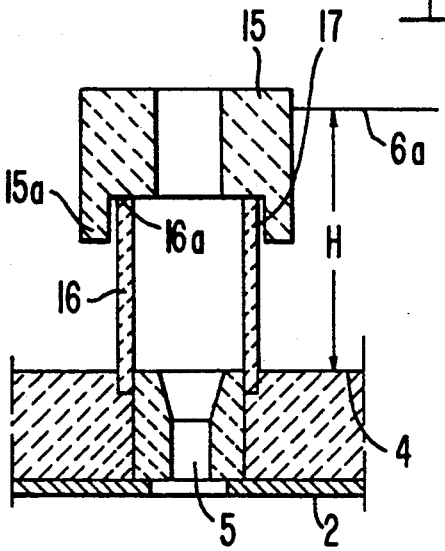
Figure 3:
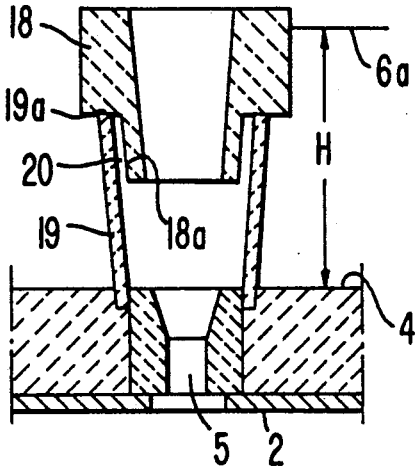

In contrast to FIG. 1, the starting member 15 shown in FIG. 2 is designed as a cap. It has an outer annular downwardly extending flange 15*a* enclosing inlet end 16*a* of starting pipe 16 and thus prevents an undesired slipping off of member 15 from pipe 16. In addition, the inflow of melt 6 into starting pipe 16 is through an annular slot 17 between guide 15*a* and starting pipe 16 and thus will be uniform. The situation is similar with starting member 18 of FIG. 3, which rests on a starting pipe 19 tapering conically inwardly in the direction of discharge orifice 5. Member 18 has a lower conically tapering flange 18*a* extending into inlet end 19*a* of pipe 19. Thus, lifting of member 18 will open a conical annular slot 20 that enlarges continuously during floating of starting member 18 and into which flows a volume of melt that also becomes continuously larger.

Figure 4:
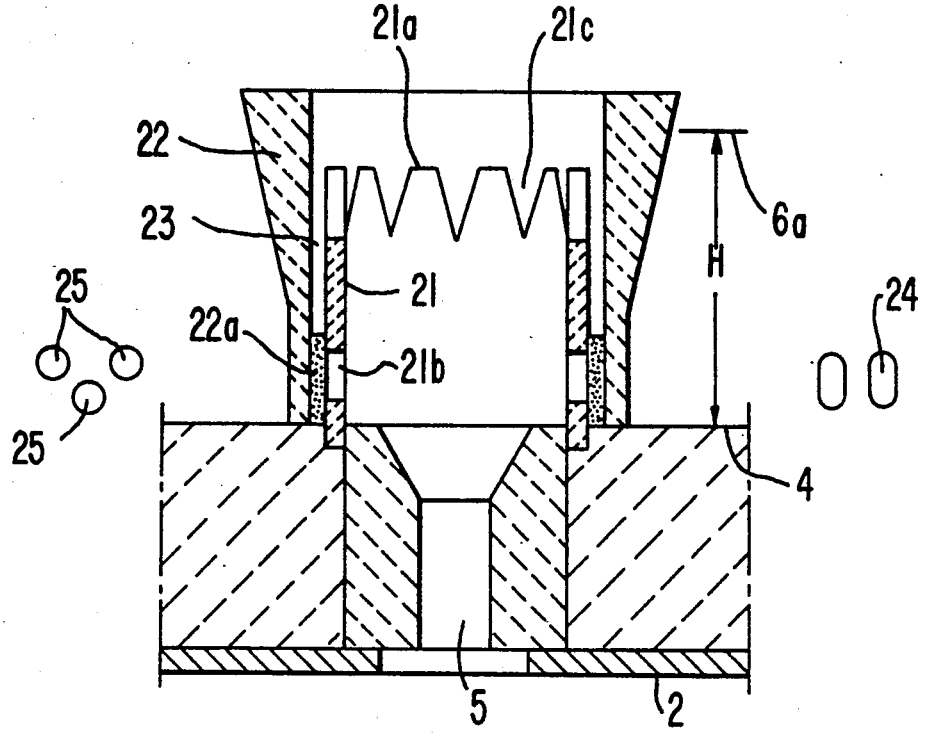

In the embodiment of FIG. 4, starting pipe 21 is provided at inlet end 21*a* thereof with leading, saw-like inflow slots or passages 21*c* and adjacent vessel bottom 4 with radial discharge orifices 21. A tubular starting member 22 encloses pipe 21 and is centered relative thereto with an annular slot 23 therebetween. Discharge orifices 21*b* are sealed by a seal 22*a* that bridges gap 23 and is arranged on starting member 22 and that is made, for example, of a flexible ceramic fiber material that is cemented on member 22. Starting member 22 starts to ascend after level height H is reached and thus eventually clears first the discharge orifices 21*b* in order for the melt 6 to flow therethrough into the discharge orifice 5. As starting member 22 continues to rise, the melt 6 is also eventually released into inlet end 21*a* of starting pipe 21 via the inflow passages 21*c* that expand vertically. Analogous to the purpose of inflow passages 21*c*, discharge orifices 21*b* can be designed as oblong holes 24 or as a group of smaller discharge orifices 25.

Figure 5:
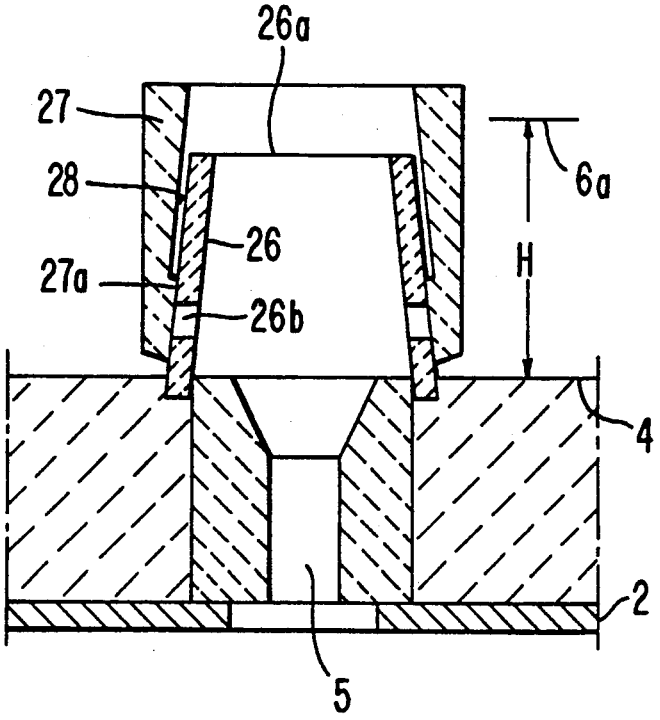

In the embodiment of FIG. 5, a starting pipe 26 expands conically in the direction of discharge orifice 5 and has discharge orifices 26*b* that are arranged near vessel bottom 4 and that are covered by an outer complementary conical starting member 27 that is fitted over pipe 26, utilizing the weight of member 27. To this end, starting member 27 has internally a sealing face 27*a* that also bridges an annular slot 28 between member 27 and pipe 26 and that gently opens discharge orifices 26*b* after melt level H has been reached during floating of starting member 27. At the same time, annular slot 28 expands just as gently in order for melt 6 to discharge via inlet end 26*a* of starting pipe 26.

It is within the scope of the invention to interchange the features of the various embodiments. For example, the area of discharge orifices 21*b* of cylindrical starting member 21 of FIG. 4 can be designed conically, in order thus to provide a seat for a seal 22*a* that also is designed conically. Similarly, the device of FIG. 4 can work without discharge orifices 21*b* and seal 22*a*. Furthermore, starting pipe 26 of FIG. 5 can be conically expanded upwardly, and starting member 27 with its sealing face 27*a* can act in the interior of starting pipe 26.

The new starting device also can be used in the described designs in a continuous casting machine which operates at a tundish 1 with nozzle 5 equipped with dies.

I claim:

1. A device for the slag-free discharge of molten material through a discharge orifice in the bottom of a vessel, said device comprising:

a starting pipe to be positioned about the discharge orifice at the vessel bottom to extend upwardly therefrom;

a starting member separate from said starting pipe and loosely positioned with respect thereto such that molten material initially introduced into the vessel is blocked from access into said starting pipe and to the discharge orifice; and said starting member having a buoyancy in the molten material such that when the level of molten material in the vessel reaches a determined level said starting member is lifted relative to said starting pipe, thereby providing access of the molten material into said starting pipe and to the discharge orifice.

2. A device as claimed in claim 1, wherein said starting member is hollow and loosely rests on an upper inlet end of said starting pipe and extends upwardly therefrom.

3. A device as claimed in claim 2, wherein said starting member has extending downwardly therefrom a projection defining an annular slot with said starting pipe.

4. A device as claimed in claim 3, wherein said projection surrounds an upper portion of said starting pipe, and said annular slot is defined between an inner surface of said projection and an outer surface of said starting pipe.

5. A device as claimed in claim 4, wherein said projection and said starting pipe expand conically downwardly.

6. A device as claimed in claim 3, wherein said projection extends into an upper portion of said starting pipe, and said annular slot is defined between an inner surface of said starting pipe and an outer surface of said projection.

7. A device as claimed in claim 6, wherein said projection and said starting pipe converge conically downwardly.

8. A device as claimed in claim 1, wherein said starting member has an upper portion projecting above an upper inlet end of said starting pipe and a lower portion, and a recess is formed in said starting member and defines an annular slot with said starting pipe.

9. A device as claimed in claim 8, wherein said starting member surrounds said starting pipe, and said annular slot is defined between an inner surface of said starting member and an outer surface of said starting pipe.

10. A device as claimed in claim 9, wherein said starting pipe expands conically downwardly.

11. A device as claimed in claim 8, wherein said starting member is positioned within said starting pipe, and said annular slot is defined between an inner surface of said starting pipe and an outer surface of said starting member.

12. A device as claimed in claim 11, wherein said starting pipe converges conically downwardly.

13. A device as claimed in claim 8, wherein said lower portion of said starting member is to be abutted against the vessel bottom.

14. A device as claimed in claim 8, wherein said lower portion of said starting member is abutted against an outer surface of said starting pipe.

15. A device as claimed in claim 8, wherein said upper inlet end of said starting pipe has formed therein inflow slots that expand upwardly.

16. A device as claimed in claim 8, wherein said starting pipe has therethrough, adjacent a lower end thereof, discharge openings covered by said lower portion of said starting member and uncovered upon lifting of said starting member.

17. A device as claimed in claim 16, wherein said lower portion of said starting member has a seal to close said discharge openings.

18. A device as claimed in claim 17, wherein said seal comprises a flexible ceramic fiber member.

* * * * *